United States Patent [19]

Brunson

[11] 4,161,440

[45] Jul. 17, 1979

[54] LIQUEFACTION OF CALCIUM-CONTAINING SUBBITUMINOUS COALS AND COALS OF LOWER RANK

[75] Inventor: Roy J. Brunson, Baytown, Tex.

[73] Assignee: Exxon Research & Engineering Co., Florham Park, N.J.

[21] Appl. No.: 853,301

[22] Filed: Nov. 21, 1977

[51] Int. Cl.[2] ..... C10G 1/00; C10G 1/06

[52] U.S. Cl. ..... 208/8 R; 208/10; 44/1 R; 44/6

[58] Field of Search ..... 44/1 R, 4–6; 208/8 R, 10

[56] References Cited

U.S. PATENT DOCUMENTS

| | | | |
|---|---|---|---|
| 1,436,289 | 11/1922 | Plauson | 208/8 |
| 2,191,156 | 2/1940 | Pier et al. | 208/10 |
| 2,221,410 | 11/1940 | Pier | 208/10 X |

*Primary Examiner*—Carl Dees

*Attorney, Agent, or Firm*—L. A. Proctor; Wayne Hoover

[57] ABSTRACT

An improved process for the treatment of a calcium-containing subbituminous coal and coals of lower rank to form insoluble, thermally stable calcium salts which remain within the solids portions of the residue on liquefaction of the coal, thereby suppressing the formation of scale, made up largely of calcium carbonate which normally forms within the coal liquefaction reactor (i.e., coal liquefaction zone), e.g., on reactor surfaces, lines, auxiliary equipment and the like. An oxide of sulfur, in liquid phase, is contacted with a coal feed sufficient to impregnate the pores of the coal. The impregnated coal, in particulate form, can thereafter be liquefied in a coal liquefaction reactor (reaction zone) at coal liquefaction conditions without significant formation of scale.

12 Claims, 1 Drawing Figure

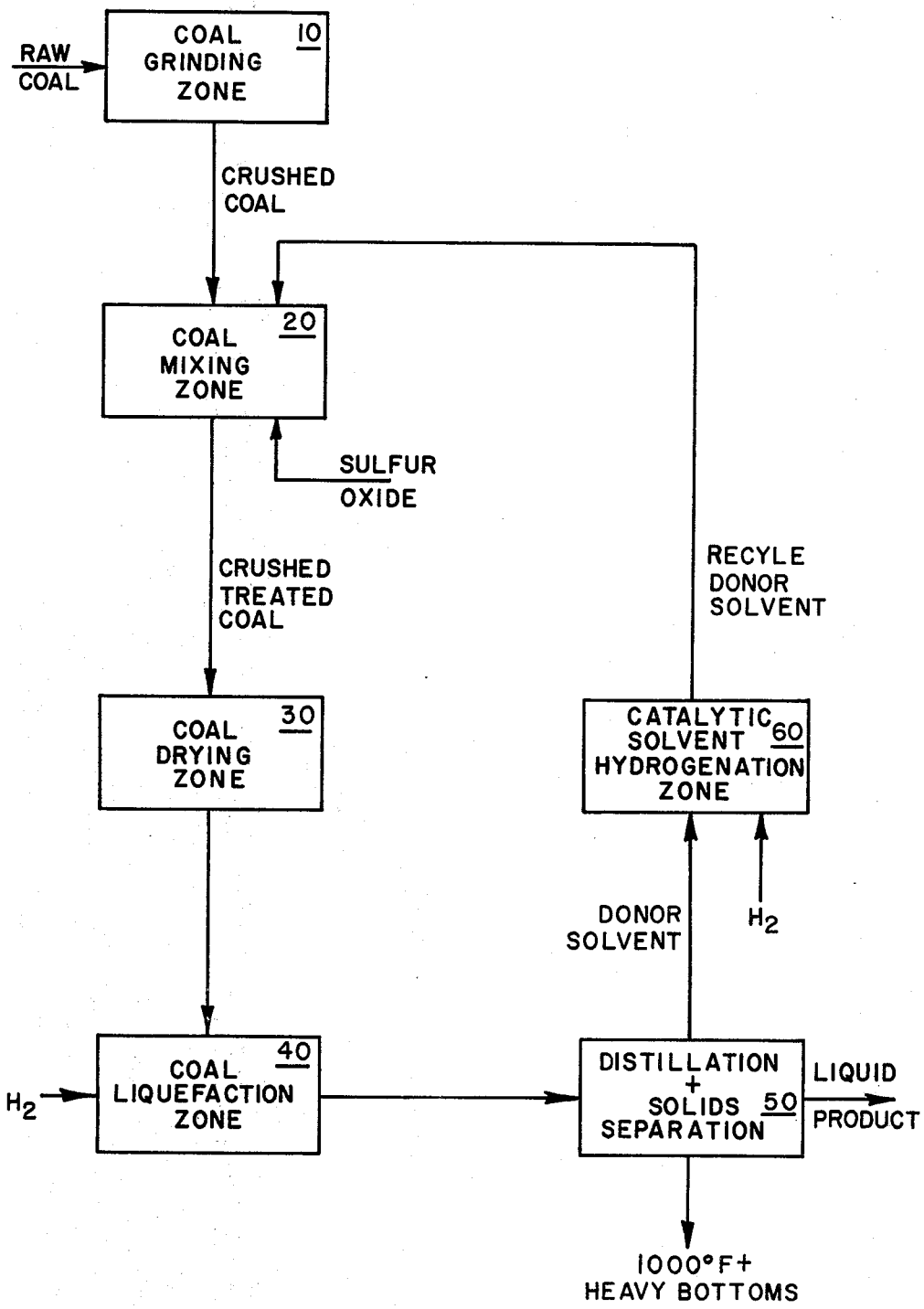
FIGURE

LIQUEFACTION OF CALCIUM-CONTAINING SUBBITUMINOUS COALS AND COALS OF LOWER RANK

The Government of the U.S.A. has rights in this invention pursuant to Contract No. E(49-18)-2353 awarded by the Energy Research and Development Administration (ERDA).

In pending application Ser. No. 798,650, filed May 19, 1977, by Martin L. Gorbaty, herewith incorporated by reference, there is disclosed an improved process for liquefying a low rank, calcium-containing coal. In this process, to avoid the formation of scale, constituted largely of calcium carbonate which normally forms on the surfaces of the coal liquefaction reactor lines, auxiliary equipment and the like, an oxide of sulfur, in vapor phase, is contacted with a coal feed sufficient to impregnate the pores of the coal so that the impregnated coal, in particulate form, can be liquefied in the coal liquefaction reactor (zone) without significant formation of scale, notably vaterite or other forms of calcium carbonate. In such treatment, the calcium is precipitated internally within the pores of the coal as thermally stable molecular species, insoluble at liquefaction conditions, the calcium forming particulate residual solids which becomes a part of the liquefaction bottoms. The calcium, is separated after liquefaction from the valuable petroleum-like products as a portion of the liquefaction bottoms.

It is quite firmly believed that the pores of the coal contain water, and that the calcium humate portion of the coal is comprised of two anionic sites, e.g., carboxylate and phenolate functional groups, one each of which projects outwardly into the liquid of the pores, and thus has two electronegative groups which are counterbalanced by a $Ca^{2+}$ ion also contained in solution within the liquid of the pore. On addition of a sulfur dioxide or sulfur trioxide gas, or admixture containing one or more of these compounds within the gaseous admixture, an anion is formed which combines with the calcium to form a molecular species which precipitates within the pore. On addition of a sulfur dioxide or sulfur trioxide gas, or admixture containing one or more of these compounds within the gaseous admixture, an anion is formed which combines with the calcium to form a molecular species which precipitates within the pore as an insoluble molecular species of calcium, perhaps $CaSO_4$, a molecular species which is thermally stable and substantially inert at coal liquefaction conditions. The insoluble $CaSO_4$, or other molecular species, in any event, forms a particulate solids which remains as a part of the residue of the liquefaction bottoms, innocuous as to scale formation. Thus, in the treatment of a subbituminous coal or coal of lower rank essentially 80 to 100 percent of the $Ca^{2+}$ ions originally present in a coal can be converted into insoluble thermally stable $CaSO_4$, or other insoluble molecular species, which remains within the coal and is released during liquefaction as particulate solids which are recovered with the liquefaction bottoms. This can be accomplished with an undried coal at ambient, or essentially ambient conditions without any necessity of heating the gas or supplying a vacuum.

The present invention is directed to improvements in the Gorbaty process and, in contradistinction to the latter, embodies a pretreatment, or preconditioning, of a subbituminous or lower rank coal by the contact thereof with an oxide of sulfur which is maintained in liquid phase. In such treatment, as in the Gorbaty process, there is formed an insoluble, thermally stable molecular species which remains as particular solids within the residue, and within the liquefaction bottoms, on liquefaction of the coal. The added sulfur oxide reacts with the calcium of the coal to form a molecular species which deposits within the pores of the coal. The molecular species is thermally stable and does not decompose at liquefaction conditions, and during liquefaction it remains as particulate solids and thereby does not form, or it at least suppresses the formation of scale, or calcium carbonate deposits. The insoluble form of calcium remains within the liquefaction bottoms, or ash, and is conveniently disposed of, after liquefaction, with the liquefaction bottoms.

Suitably, the oxide of sulfur can be liquefied by cooling, but preferably is liquefied by increasing the total pressure above the vapor pressure of the sulfur dioxide or sulfur trioxide, or admixture thereof, during the period that the sulfur oxide is maintained in contact with a coal feed. In such treatment, a particulate coal feed is contacted with said oxide of sulfur containing liquid for a period sufficient for impregnation of said sulfur oxide into the pores of the coal, suitably for a period ranging at least about 0.01 hours to about 24 hours, preferably at least about 0.1 hours to about 4 hours. Suitably, in treatment of the coal with sulfur dioxide the pressure is maintained at least about 0 pounds to about 300 per square inch gauge (psig) at ambient temperature, preferably from about 10 psig to about 300 psig. Whereas elevated temperatures can be employed temperature is not critical though, generally, temperatures range from about 32° F. to about 190° F., preferably from about 50° F. to about 120° F. In a preferred embodiment, the sulfur oxide is added to a liquid, suitably an indiginous liquefied process stream within which the coal is to be slurried prior to passage to the coal liquefaction reactor, or coal liquefaction zone. This method of treatment maintains a constant moisture content in the coal, moisture being important in the pretreatment. The solvent also causes the coal to swell even at pretreat temperatures, this enlarging the pores of the coal to enhance the rate and effectiveness of the sulfur oxide treatment. Moreover, however, the liquid phase treatment increases the rate of sulfur oxide absorption by the coal vis-a-vis gas phase treatment based on concentration effects. For example, pure sulfur dioxide gas at one atmosphere of pressure has a concentration of 0.04 moles/liter of gas whereas, in sharp contrast, a ten percent solution of sulfur dioxide in solution provides a concentration of 1.6 moles/liter of sulfur dioxide. Thus, use of sulfur dioxide in solution provide greater concentrations of sulfur dioxide at larger pore sites which permit more efficient penetration of the coal particles by the sulfur oxides. Use of solvent also reduces the loss of very fine coal particles and generally simplifies the handling and transport of the coal. It also reduces the number of steps as contrasted with vapor phase treatment as employed in the Gorbaty process, reduces contact time, facilitates separation of the sulfur oxide treat facilitates handling of the treat stream, and provides advantages in the maintenance of a purified sulfur oxide containing stream.

In the best mode of practicing the present invention, a subbituminous or lower rank undried, or raw coal feed is crushed, ground or reduced in size, contacted and slurried with a recycle solvent in to which is added the sulfur oxide, the slurry being subjected to pressure adequate to maintain the sulfur oxide in solution. Suitably, the coal is first reduced in size in an initial zone, and the particulate coal feed, recycle solvent stream and sulfur oxide are added to a subsequent mixing zone. The preferred sequence of process steps are generally described by reference to the attached schematic figure and includes generally (a) a first zone 10 wherein a particulate subbituminous or lower rank raw coal is ground to size ranging below about ⅛ inch diameter, suitably to an average particle size diameter of about −8 mesh (NBS) (b) a mixing zone 20 within which the particulate raw coal is slurried with an internally generated or indiginous liquids fraction, and to which is added a sulfur oxide, the system being pressurized to maintain the sulfur oxide in liquid phase, (c) a drier 30 in which the treated particulate coal is dried to remove moisture, and excess sulfur oxide, (d) a coal liquefaction zone 40 within which a slurry of the impregnated coal and hydrogen are fed, and the coal liquefied, (e) a distillation and solids separation zone 50 within which a solvent fraction, a 1000° F.+ heavy bottoms fraction, and liquid product fraction are separated, and preferably (f) a catalytic solvent hydrogenation zone 60 wherein the solvent fraction is hydrogenated prior to its being recycled to said mixing zone 20.

In coal grinding zone 10 an "as received" or undried raw low rank coal is ground by conventional means to particulate solids preferably of particle sizes ranging from about −8 to 20 mesh.

The particulate raw coal is then admixed in zone 20 with an indiginous recycle hydrogen donor solvent stream. The total solvent and coal are admixed or slurried in a solvent-to-coal ratio ranging from about 0.8:1 to about 4:1, preferably about 1.2:1 to about 1.6:1, based on weight. The solvent is one which boils within the range of about 250° F. to about 850° F., preferably from about 290° F. to about 700° F. Sulfur oxide, preferably sulfur dioxide, is introduced into this zone and the pressure maintained at about 0 psig to about 300 psig, preferably from about 10 psig to about 50 psig. The period of contact, at temperature ranging from about 32° F. to about 190° F., generally ranges from about 0.1 hour to about 4 hours, sufficient to impregnate the pores of the coal with the sulfur oxide.

The coal, after the impregnation is then introduced into drying zone 30 wherein the bulk of the water and sulfur oxide are removed by heating at temperature ranging from about 200° F. to about 300° F., preferably from about 210° F. to about 230° F., and at pressures ranging from about 0 psig to about 50 psig, preferably from about 0 psig to about 15 psig. The particulate coal slurry is then introduced to liquefaction zone 40.

Within the coal liquefaction zone 40, liquefaction conditions include a temperature ranging from about 700° F. to about 950° F., preferably from about 800° F. to about 850° F., with pressures ranging from about 300 psia to about 3000 psia, preferably from about 800 psia to about 2000 psia. Preferably, molecular hydrogen is also added to the liquefaction zone 40 at a rate from about 1 to about 6 weight percent (MAF coal basis), liquid residence times ranging from about 5 to about 130 minutes, and preferably from about 10 to about 60 minutes.

The product from the coal liquefaction zone 40 consists of gases and liquids, the liquids comprising a mixture of undepleted hydrogen-donor solvent, depleted hydrogen-donor solvent, or compounds, dissolved coal, undissolved coal and mineral matter. The product thus includes petroleum-like liquids, i.e., 1000° F.− liquids, and heavier products. The heavy products, or "liquefaction bottoms," consist of 1000° F.+ organics, inorganics and carbon residue (fusinite). The material, which analyzes about 60–70 wt. % carbon, and about 20 wt. % ash, is less useful than the 1000° F.− liquid, and generally contains 40–50 wt. % of the original feed coal to the process.

The liquid mixture, in any regard, is transferred from coal liquefaction separation zone 50 wherein light fractions boiling below 400° F. useful as fuel gas and naphtha are recovered, and intermediate fractions boiling, e.g., from 400° F. to 700° F. are recovered for use as a hydrogen donor solvent. Heavier fractions boiling from about 700° F. to 1000° F. are also recovered, and bottoms fractions boiling above 1000° F., including char, mineral matter and ash are withdrawn for use in a gasification process or for coking, as desired.

The solvent fraction, typically a 400°–850° F. fraction, and preferably a 400°–700° F. fraction, is introduced into a catalytic solvent hydrogenation zone 60 to upgrade the hydrogen content of that fraction. The conditions maintained in hydrogenation zone 60 hydrogenate and, if desired, conditions can be provided which produce substantial cracking. Temperatures normally range from about 650° F. to about 850° F., preferably from about 700° F. to about 800° F., and pressures suitably range from about 650 psia to about 2000 psia, preferably from about 1000 psia to about 1500 psia. The hydrogen treat rate ranges generally from about 1000 to about 10,000 SCF/B, preferably from about 2000 to about 5000 SCF/B. The hydrogenation catalysts employed are conventional. Typically, such catalysts comprise an alumina or silica-alumina support carrying one or more Group VIII non-noble, or iron group metals, and one or more Group VI-B metals of the Periodic Table. In particular, combinations of one or more Group VI-B metal oxides or sulfides with one or more Group VIII metal oxides or sulfides are preferred. Typical catalyst metal combinations include oxides and/or sulfides of cobalt-molybdenum, nickel-molybdenum, nickel-tungsten, nickel-molybdenum-tungsten, cobalt-nickel-molybdenum and the like. A suitable cobalt molybdenum catalyst is one comprising from about 1 to about 10 weight percent cobalt oxide and from about 5 to about 40 weight percent molybdenum oxide, expecially about 2 to 5 weight percent cobalt and about 10 to 50 weight percent molybdenum. Methods for the preparation of these catalysts are well known in the art. The active metals can be added to the support or carrier, typically alumina, by impregnation from aqueous solutions followed by drying and calcining to activate the composition. Suitable carriers include, for example, activated alumina, activated alumina-silica, zirconia, titania, etc., and mixtures thereof. Activated clays, such as bauxite, bentonite and montmorillonite, can also be employed.

These and other features of the present invention will be better understood by reference to the following demonstrations of prior art runs conducted by liquefaction of raw coal, or coal which has not received the benefit of any pretreatment with a sulfur oxide, by pretreatment involving gas phase contact of the coal with sulfur oxide, and to comparative data showing liquefaction of coal pretreated with liquid phase sulfur oxide and sulfur oxide-containing solvents as used in accordance with this invention. Comparative data are given which show the amount of calcium carbonate contained in the product obtained from untreated coal, from coal pretreated by gas phase contact with sulfur oxide, and coal pretreated with sulfur oxide liquids pursuant to this invention. All units are in terms of weight unless otherwise specified.

EXAMPLES

Similar, 10 gram portions of −8 mesh Wyodak coal (or Arkansas lignite) on an as received basis and containing 30 weight percent moisture, were charged into tubing bombs, each contacted and immersed, respectively, in liquid phase sulfur dioxide or various solvents sufficient to provide a 1:1 solvent:coal ratio, to which sulfur dioxide gas was added over a 10–15 minute period. The temperature and pressure on the liquid sulfur dioxide, or system at the time of sulfur dioxide addition to the solvent is recorded in the table below. The specimens were then removed from the bomb, filtered, the separated coal then washed in cyclohexane, and then dried in an oven at 220° F. The dried coal was then replaced in its respective tubing bomb, and tetralin was added.

Another ten gram portion of the coal, similar to those treated with the liquid phase sulfur dioxide system, or solvent mixtures, was then treated by gas phase contact with the sulfur dioxide over a similar period, and another similar portion of coal was left untreated. These portions of coal, like those treated in accordance with this invention, were then charged, with tetralin, into tubing bombs.

All of the bombs were then placed in a sandbath and heated to 840° F. for a period of 40 minutes to liquefy the specimens of coal. The bombs, at the end of the period, were then rapidly quenched in cold water. In a series of separate manipulations, each of the bombs were then opened and the total contents of each extracted with methylethylketone (MEK). After the several washings, the MEK specimens were centrifuged, and the recovered solids washed several times with additional MEK, taking care in each instance to recover as much of the solids as possible. These manipulations completed, the several solid specimens were dried in a vacuum oven at 220° F. The solid specimens were analyzed to determine the amount of ash and calcium carbonate contained in each specimen, with the results given in the table below.

TABLE

| | $CaCO_3$ in Residue Wt. % On Ash | | Conditions of Treatment With $SO_2$ | |
|---|---|---|---|---|
| Coal Pretreatment | Solvent/ Coal | | Temp., °F. | Press., °F. |
| None | — | 40 | — | — |
| $SO_2$ Gas Phase | — | 8 | — | — |
| Liquid $SO_2$ | — | 2.9 | 34 | — |
| Toluene | 1/1 | 6.6 | 76 | 43 |
| Low Donor(1) | 1/1 | 5.8 | 87 | 60 |
| High Donor(1) | 1/1 | 1.4 | 87 | 60 |
| Tetralin | 1/1 | 7.0 | 70 | 38 |
| Decalin | 1/1 | 10.5 | 70 | 38 |

(1)Arkansas lignite in these instances were treated with low donor solvent and high donor solvents indigenous to the process. Both solvents boiled within the 400°–800° F. range, the low donor solvent containing about 0.8% donor hydrogen whereas the high donor solvent contained about 1.6% donor hydrogen.

These data clearly show that far more of the calcium carbonate was contained within the solids liquefaction bottoms of the untreated, or raw specimen of coal. Though treatment of the coal with sulfur dioxide in gas phase reduced the amount of calcium carbonate formation, the data clearly shows that the liquid phase sulfur dioxide and sulfur dioxide-containing solvents were generally more effective (the only exception being decalin) than the gas phase treatment.

It is apparent that various modifications can be made without departing the spirit and scope of the invention. For example, whereas sulfur oxides can be added to various solvents per se for use in pretreating the coal, a preferred solvent of which is one indigenous to the process, it is also quite feasible to pretreat the coal with virtually any solvent and sulfur oxide in an initial step, thereafter separate the initial pretreat solvent from the coal, and then add the indigenous solvent to the coal for use in effecting the liquefaction. In a preferred embodiment, e.g., wet coal is treated with sulfur dioxide and toluene, and thereafter, in a drier, the water and toluene are separated from the coal as an azeotrope. Recycle solvent is then added to the dry coal and charged as a slurry to the liquefaction zone.

Having described the invention what is claimed is:

1. A process for liquefying a calcium-containing subbituminous coal and coals of lower rank comprising:

(a) contacting said coal with a sulfur oxide, maintained in the liquid phase, to form within the pores of said coal a water-insoluble, thermally stable calcium compound; and (b) liquefying the treated coal at a temperature within the range from about 700° F. to about 950° F. and at a pressure within the range from about 300 psia to about 3000 psia.

2. The process of claim 1 wherein the sulfur oxide is sulfur dioxide.

3. The process of claim 1 wherein the sulfur oxide is sulfur trioxide.

4. The process of claim 1 wherein the sulfur oxide is constituted of an admixture of sulfur dioxide and sulfur trioxide.

5. The process of claim 1 wherein the sulfur oxide is dissolved in a solvent, and maintained under pressure.

6. The process of claim 5 wherein impregnation of the coal with the sulfur oxide is conducted at pressures ranging from about 0 to about 300 psig.

7. The process of claim 6 wherein the pressure ranges from about 10 to about 300 psig.

8. The process of claim 1 wherein contact between the particulate coal and the sulfur oxide is maintained for a period ranging at least about 0.01 to about 24 hours.

9. The process of claim 1 wherein the liquefaction is accomplished in the presence of a solvent which comprises a hydrogen-donor compound.

10. The process of claim 9 wherein the temperature of liquefaction ranges from about 800° F. to about 850° F., and the pressure ranges from about 800 psia to about 2000 psia.

11. The process of claim 9 wherein the hydrogen donor solvent is one which boils within a range of from about 400° F. to about 850° F., and contains at least about 30 wt. % hydrogen donor compounds.

12. The process of claim 9 wherein the coal is initially contacted with a first solvent which contains sulfur oxide, the coal is thereafter dried, and then contacted and liquified with a second solvent indigenous to the process.

* * * * *